United States Patent [19]

Krause et al.

[11] 4,064,711

[45] Dec. 27, 1977

[54] SAFETY STOPPING DEVICE FOR KNITTING MACHINE

[75] Inventors: Erich Krause; Hans Schieber, both of Bopfingen, Germany

[73] Assignee: Universal Maschinenfabrik Dr. Rudolf Schieber KG, Westhausen, Germany

[21] Appl. No.: 729,629

[22] Filed: Oct. 5, 1976

[30] Foreign Application Priority Data

Oct. 10, 1975 Germany ..... 2545560

[51] Int. Cl.[2] ..... D04B 35/10

[52] U.S. Cl. ..... 66/157

[58] Field of Search ..... 66/157, 64, 60 R, 126 R

[56] References Cited

U.S. PATENT DOCUMENTS 824,565 6/1906 Morris ..... 66/157 X

FOREIGN PATENT DOCUMENTS 105,690 10/1898 Germany ..... 66/157

172,519 6/1906 Germany ..... 66/157

14,732 of 1907 United Kingdom ..... 66/157

*Primary Examiner*—Wm. Carter Reynolds

*Attorney, Agent, or Firm*—Sughrue, Rothwell, Mion, Zinn and Macpeak

[57] ABSTRACT

A hood movable in the direction in which pinching of the operator's hand would occur extends across the stationary part and between the stationary part and the movable part of a straight knitting machine such that a machine stopping mechanism can be triggered by movement of the hood by impact of the hood by the operator's hand to insure stopping of the machine prior to the machine movable part reaching the stationary part covered by the hood.

5 Claims, 2 Drawing Figures

SAFETY STOPPING DEVICE FOR KNITTING MACHINE

BACKGROUND OF THE INVENTION

1. Field of the Invention

This invention relates to a knitting machine, particularly a straight knitter, and to a stopping mechanism which may be triggered to stop the machine in the event of danger to the machine operator.

2. Description of the Prior Art

Knitting machines of this type are disclosed, for example, in "Strickerei-und Wirkerei-Technik" volume of Apr. 1963 No. 4. In such knitting machines, a machine stopping mechanism is triggered to turn the machine off to provide protection against possible pinching of the operator's hand between any one of several movable parts of the machine and a fixed part of the machine during manipulation while knitting is being carried out.

Knitting machines generally have very many movements of individual units of the machine which take place during machine operation. Some of these units involve in turn many movements, such as, for example, a gear unit may be arranged and fitted in such a way that such units are not a source of possible injury to the operator of the machine. However, other units cannot be covered or shielded from the operator, or if shielded, are not sufficiently shielded since their mode of operation makes such shielding impossible.

For example, it is necessary for the slide of the knitting machine to move into the area of one or more stops which are stationarily mounted on the machine frame so as to enable the stops to actuate the slide and cam bolts. Although it is possible to cover the area in which the stops are located in such a way that the operator can not reach his hand into this area, an area of danger still exists at the place where the cover or shield exists, particularly the sides of the cover, thus the cover itself creates an area between the cover and the slot where pinching of the operator's hand may occur. Practical safety devices for such areas of danger have not hitherto been satisfactorily effected.

Therefore, it is an object of the present invention to provide a safety device for a knitting machine which provides sufficient protection against injuries and particularly against injuries at places where pinching of the operator's hand may occur between stationary parts of the machine and its movable parts.

According to the present invention, this object is achieved in that in the area of each of the parts which are stationarily mounted on the knitting machine in the vicinity with a movable part that could cause pinching of the hand therebetween, a hood is provided which is mounted for movement in a direction in which pinching could occur which extends across stationary part and between that stationary part and the movable part and by the provision of a stopping mechanism for stopping the operation of the knitting machine which is triggered by movement of the hood by contact of the operator's hand. The safety device of the present invention insures, therefore, that after the hood covers the area where pinching could occur, pinching is in no way possible despite further travel of the movable part over a necessarily occuring braking distance after the knitting machine has been switched off by the stopping mechanism since the hood, being movable, deflects over the braking distance of the movable part without uncovering the stationary part. Preferably, the hood is swivelable and may be mounted by way of a parallelogram guide system. However, in the alternative, the hood may be mounted for translatory displacement, particularly in guide tracks.

The stopping mechanism may comprise a microswitch which is opened and closed upon movement of the hood and which is employed for triggering the termination of knitting machine operation by opening a circuit to the microswitch.

The hood is preferably movable to a distance equal to the greatest braking distance of the movable part of the knitting machine after triggering of the brake or stopping mechanism plus a reserve distance. This insures that even in the case of differing speeds and resultant differing braking distances of the movable part that may cause pinching of the operator's hand, the distance through which the hood swings or is linearly displaced is sufficient to insure with certainty that pinching is avoided.

The safety device in accordance with the present invention may be used at various locations on the knitting machine, for example in the area of stops, of the drive mechanism, and of an automatic starting comb.

An embodiment of the invention for use in a particular case is illustrated in the drawing and will now be described in greater detail.

DESCRIPTION OF THE PREFERRED EMBODIMENT

Figure 1:
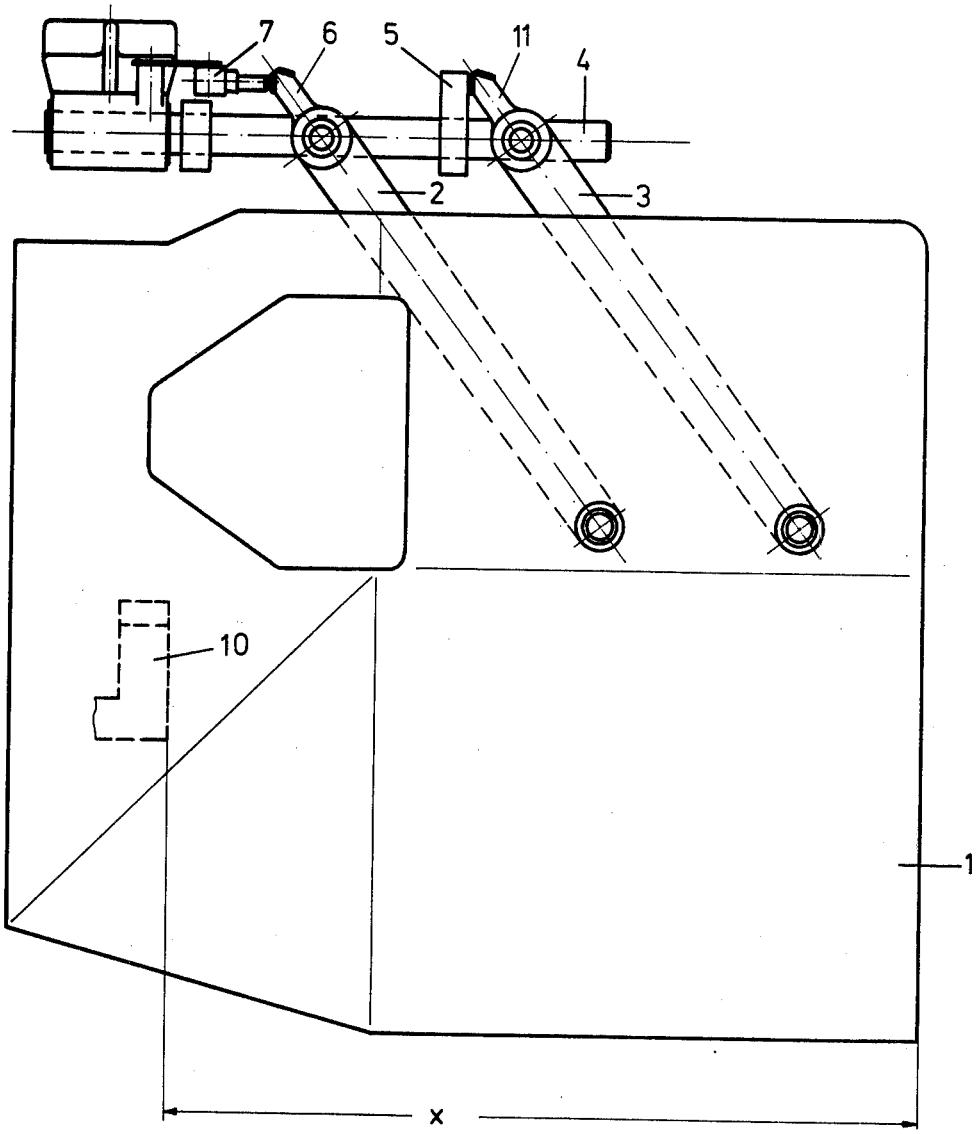
FIG. 1 is a plan view of a hood forming a portion of the safety device of the present invention supported by means of a parallelogram guide system on a stationary part of the knitting machine with the hood being shown in the rest position with the microswitch contacts closed.

Reference to the figures shows a hood 1 which overlies and has a portion extending across a stationary part on stop 10 of a knitting machine, the stationary part 10 being for example, in this case, a stop for a movable element of the machine such as slide 9. The hood 1 is swivelably secured by a parallelogram guide or support system mounted to the machine, the parallelogram guide system incorporating a pair of arms as at 2 and 3 which are pivotably mounted at one end to hood 1 and at the other end to retaining arm 4 at correspondingly spaced positions along that retaining arm. An abutment 5 is fixed to the retaining arm 4 intermediate of the pivot connection points for arms 2 and 3, the arm 3 including as an extension thereof a lug 11 which bears against the abutment 5 and serves as a limit in the distance of travel of hood 1 towards its rest position as shown in FIG. 1. A similar lug 6 is formed on arm 2 and bears against the plunger of a microswitch 7 when the hood is in the rest position. Misroswitch 7 is electrically connected to the driving means for the knitting machine such that as soon as lug 6 by way of clockwise rotation of arms 2 and 3, FIG. 1, releases the microswitch 7, a stopping mechanism for the knitting machine (not shown) which is conventional is triggered so that the movable part or slide 9 of the knitting machine may be brought to a stop to prevent pinching of the operator's hand 8.

Figure 2:
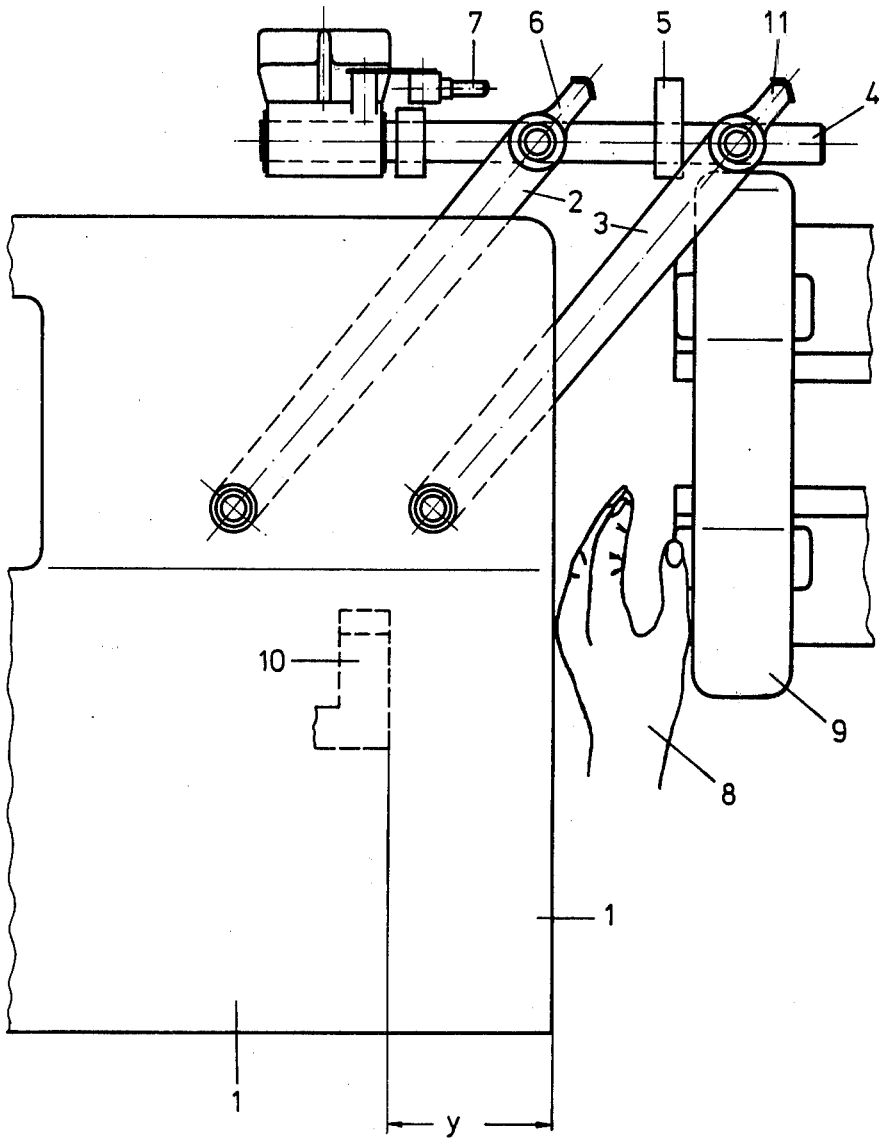
FIG. 2 is a similar plan view of the safety device of FIG. 1, with the hood swiveled to microswitch open contacts position.

Turning to FIG. 2, the hood 1 is shown as being swung from right to left away from its rest position. The swinging movement is imparted by hand 8 of the user or operator which is in the danger area, that is, between the movable part or slide 9 and the stationary part or stop 10. In this case, the hand 8 which has been engaged by the movable part 9 is pressed against the side of hood 1 and the hood then moves from its rest position, releases the microswitch 7 and thus triggers the mechanism for stopping the movable part 9 that could cause pinching. Upon triggering of the stopping mechanism, the movable part or slide 9 comes to a stop before the hand 8 of the operator can be pressed against the stationary part or stop 10. However, since the hood 1 is displaced between the rest position shown in FIG. 1 and the position shown in FIG. 2, no pinching of the operator's hand 8 may occur.

In order to assure in a reliable manner that the danger of pinching at any likely speed of movable part 9 is avoided and to provide for any reasonable braking distance over which part 9 travels after triggering of the stopping mechanism, the distance $x$ over which hood 1 may be maximumly displaced in greater than the maximum braking distance of the movable part 9, so that, as shown in FIG. 2, at least a reserve distance $Y$ is always present when the knitting machine comes to a stop.

While the invention has been particularly shown and described with reference to a preferred embodiment thereof, it will be understood by those skilled in the art that various changes in form and details may be made therein without departing from the spirit and scope of the invention.

What is claimed is:

1. In a knitting machine having a stationary part and a movable part mounted for movement relative to the stationary part and being driven in a direction which could cause pinching of the operator's hand between the movable part and the stationary part and having a stopping mechanism which may be triggered to terminate movement of the movable part in the event of danger and a hood covering the stationary part, the improvement comprising:

means for mounting said hood on said machine in a position extending across the stationary part and between the stationary part and the movable part for movement in the direction in which pinching of the operator's hand could occur, and means for triggering said stopping mechanism in response to movement of said hood in said direction to prevent pinching of the operator's hand when the operator's hand is caught between said movable member and said hood, and wherein said means for mounting said hood comprises means for permitting said hood to move through a distance equal to the maximum braking distance of said movable part of the knitting machine after triggering of the braking mechanism plus a reserve distance.

2. The knitting machine according to claim 1, wherein said means for mounting said hood comprises swivelable means.

3. The knitting machine according to claim 2, wherein said swivelable means comprises a parallelogram guide system including a pair of parallel arms pivotably mounted respectively at their one ends, to said hood, and at their other ends to said stationary part of said machine.

4. The knitting machine according to claim 1, wherein said means for mounting said hood comprises means for causing rectilinear movement of said hood with respect to said stationary part of said machine.

5. The knitting machine according to claim 1, wherein said means for triggering the stopping mechanism of the knitting machine comprises a microswitch which is operatively positioned with respect to said hood such that movement of said hood acts to change the state of said microswitch.

* * * * *